United States Patent [19]

Eagle

[11] 4,063,846

[45] Dec. 20, 1977

[54] PUMP IMPELLER IMPROVEMENT

[75] Inventor: Lawrence G. Eagle, Tulsa, Okla.

[73] Assignee: Borg-Warner Corporation, Chicago, Ill.

[21] Appl. No.: 523,394

[22] Filed: Nov. 13, 1974

[51] Int. Cl.[2] ..... F04D 29/44; F04D 13/08

[52] U.S. Cl. ..... 415/199.2; 415/170 A; 308/163

[58] Field of Search ..... 415/104, 105, 106, 199 A, 415/501, 170 A; 308/163

[56] References Cited

U.S. PATENT DOCUMENTS

| | | | |
|---|---|---|---|
| 1,169,057 | 1/1916 | Thomson | 308/165 |
| 1,525,884 | 2/1925 | Plummer | 415/170 A |
| 1,983,392 | 12/1934 | Nilsson | 415/170 A |
| 2,606,083 | 8/1952 | Kitto | 308/163 |
| 2,713,806 | 7/1955 | Dodge | 85/51 |
| 2,762,198 | 9/1956 | Ullery | 60/346 |
| 2,775,945 | 1/1957 | Arutunoff | 415/199 A X |
| 2,813,732 | 11/1957 | Hird | 403/377 |
| 3,194,615 | 7/1965 | Weasler | 308/37 |
| 3,265,001 | 8/1966 | Deters | 415/199 A X |
| 3,331,643 | 7/1967 | Kinpei Okano | 308/160 |
| 3,460,843 | 8/1969 | Jaeger | 415/170 A X |
| 3,512,788 | 5/1970 | Kilbane | 415/106 X |
| 3,612,716 | 10/1971 | Deters | 415/199 A X |
| 3,730,641 | 5/1973 | Gordon | 415/501 X |
| 3,779,667 | 12/1973 | Johnson | 415/170 A |

FOREIGN PATENT DOCUMENTS

| | | | |
|---|---|---|---|
| 78,434 | 9/1919 | Austria | 415/170 A |
| 1,110,660 | 3/1967 | United Kingdom | 415/170 A |
| 130,346 | 11/1959 | U.S.S.R. | 415/170 A |

*Primary Examiner*—Martin P. Schwadron
*Assistant Examiner*—Abraham Hershkovitz
*Attorney, Agent, or Firm*—Aubrey L. Burgess

[57] ABSTRACT

To retain thrust washers and to prevent them from spinning or rotating at speeds less than the pump impeller with which they are associated, the thrust washers are slotted or split. The slotted or split washers expand due to centrifugal force and due to the difference in velocity across the face of the washer when the impeller spins; expansion of the thrust washer causes a braking force against the retaining ring on the impeller, so that the washer rotates with and at the same speed as the impeller.

3 Claims, 4 Drawing Figures

PUMP IMPELLER IMPROVEMENT

BACKGROUND OF THE INVENTION

In multistage pumps for pumping well fluid from oil and water wells, it is common practice to interpose thrust washers to support rotating impellers and to absorb thrust loads experienced during pumping. Lubrication for these thrust washers is provided by the fluid being pumped, which, at times, may contain abrasive particles, such as sand. Generally these thrust washers are received in an annular groove or retaining ring portion of the impeller closely adjacent to an annular skirt portion of the impeller. Preferably the thrust washers are inserted in the grooves with a slight interference fit; but because of manufacturing tolerances, this is not always the case. Thus, at times, thrust washers because of their size and because they are placed between a stationary part (a diffuser) and a rotating part (an impeller) tend to spin or rotate at speeds less from that of the impellers. When used in abrasive fluids, as when there are sand particles present, the difference in rotational speeds of the washers and the impellers causes excessive wear that at times is so severe as to damage one or more of the skirt portions of the impeller.

Attempts to retain these thrust washers by glueing, cementing, and staking the washers in position, or by peening and crimping various parts of the impeller have not been successful nor economically feasible.

THE INVENTION

To successfully retain a thrust washer in an impeller and to prevent it from rotating or spinning at a speed less than that of the rotational speed of the impeller the thrust washer is split or slotted, thus reducing or eliminating damage to the impeller. When a split thrust washer is used in a pump and received in a retaining ring on the impeller, the centribugal force and the difference in velocity across the face of the washer forces the washer to expand, so as to become larger in diameter thus causing it to be forced against the retaining ring. The impeller and the thrust washer then rotate together at substantially the same speed.

THE DRAWINGS

DETAILED DESCRIPTION

Figure 1:
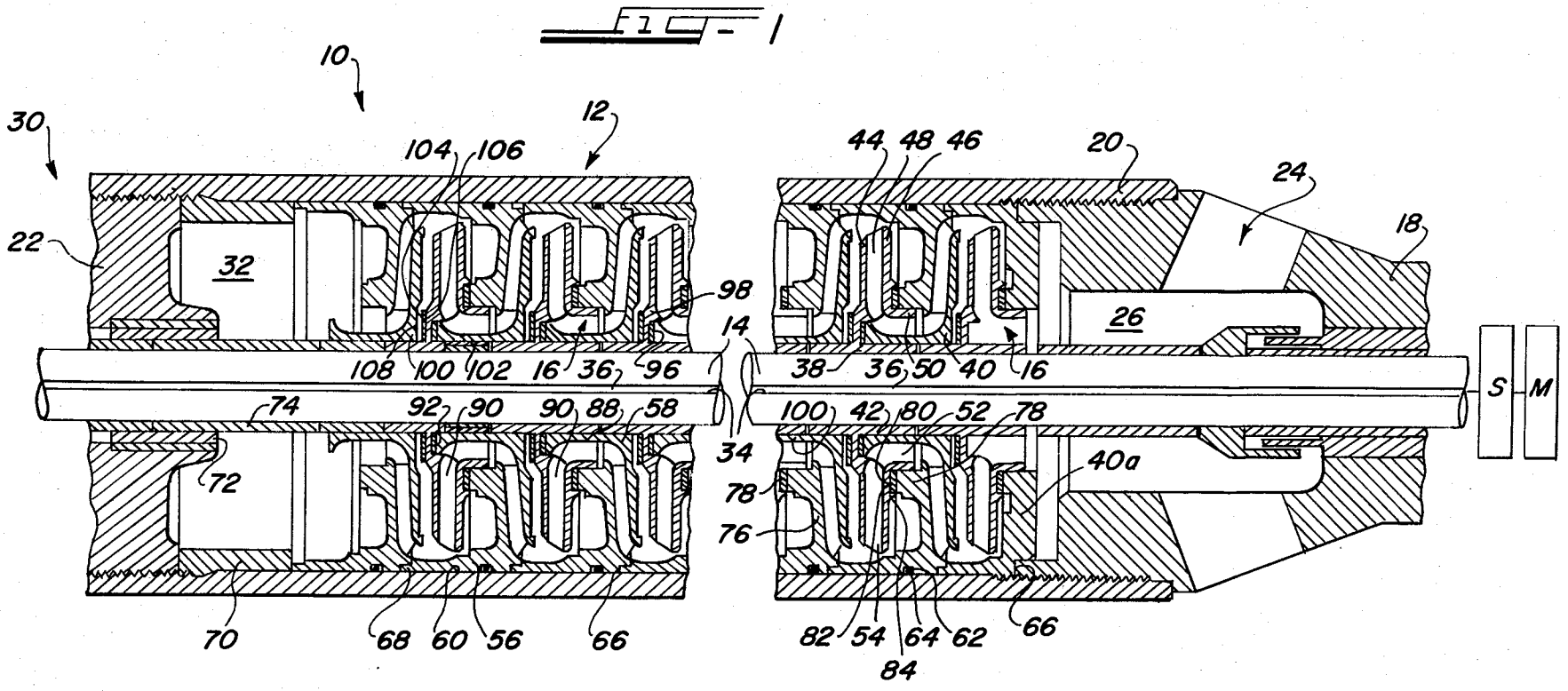
FIG. 1 is a longitudinal sectional view of a portion of a typical multi-stage pump having a plurality of impellers and thrust washers according to this invention.

Referring now to the drawings and more particularly to FIG. 1, there is illustrated a multistage pump adapted for use in an oil or water well and in which the invention is illustrated in its best mode.

The multistage pump of the illustrated embodiment, generally designated as 10, is of the submersible type and is adapted to be disposed within the casing of an oil or water well beneath the surface of the well fluid. Typically, it is adapted to be associated with an electric motor and a seal assembly shown schematically at M and S, respectively, to provide a complete pumping apparatus for the removal of well fluid. In the embodiment illustrated a simple inlet structure is used which allows well fluid to enter the pump without effecting removal of gases. Alternatively, the assembled structure may include a gas separator (not shown) which may be disposed between the seal assembly and the pump and which defines a fluid inlet structure and serves to disperse entrained gases from the well fluid. In either structure, the use of the invention to be described is the same.

The pump 10 comprises a pump housing 12, a rotatable drive shaft 14 and a plurality of pump stages 16 disposed within the housing.

The housing 12 has a pump base 18 threadably received in the housing wall 20 adapted to be connected to a gas separator, if used, or other inlet defining structure, and in the embodiment illustrated, connected to the seal section S. The pump housing 12 also has a tubular wall 20 and a pump head section which includes a top bearing housing 22 threadably received in the tubular wall 20. The entire housing structure is disposed concentrically of the shaft 14.

The pump base 18 has a fluid inlet 24 and is so shaped to provide with the shaft an inlet passage 26 which leads to the first of the pump stages 16. The pump base also has a radially directed support surface 28 which is in contact with and provides support for the first of the pump stages.

The pump head, generally identified as 30, includes an end (not shown) adapted to be connected to a string of well pipe which conducts the pumped fluid to the surface. It additionally defines a fluid outlet passage 32 which receives the pumped fluid from the pump stages 16 for delivery to the pipe string.

The lower end of the shaft 14 may be splined or otherwise suitably formed, so as to be connected to the output shaft of the motor M by an appropriate connector, not shown. The shaft 14 extends the entire length of the tubular portion 20 of the pump housing 12 and terminates in an upper end above the pump states 16. Means such as grooves and snap rings, not shown, may be provided to retain the shaft within the pump assembly.

A longitudinally extending keyway 34 is provided in the shaft within which is disposed a key 36 operatively associated with the pumping stages to effect the rotation thereof and to effect pumping of the well fluid.

Figure 3:
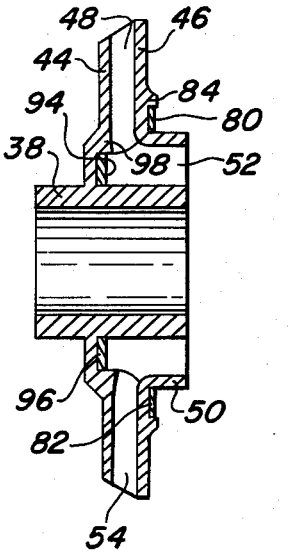
FIG. 3 is a cross section of a typical pump impeller with thrust washers in their respective locations.
Figure 2:
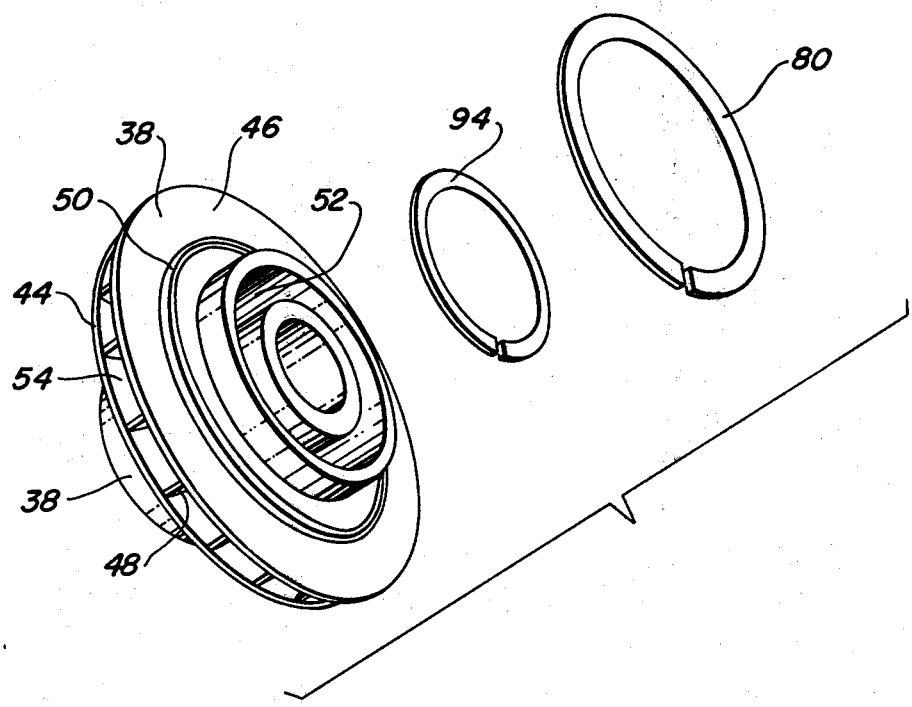
FIG. 2 is an exploded isometric view of a typical impeller and thrust washers.

Each of the pumping stages 16 of the pump comprises an impeller 38 (see also FIG. 2 and 3) and a diffuser 40 which cooperate to pump well fluid from the inlet 24 to the outlet passage 32.

The impellers 38 include an annular hub 42 keyed to the shaft 14 by the key 36 for rotation with the shaft 14. Each impeller also includes upper and lower radially directed rings 44 and 46, respectively, connected by a plurality of webs 48. The ring 46 has a circular flange portion 50, disposed concentric to the hub 42. These impeller rings define a fluid flow passage through the each impeller which includes an axially directed inlet 52 and a radially directed outlet 54.

The diffusers 40 are arranged intermediate adjacent impellers and serve to direct the pumped fluid from the outlet 54 of one stage to the inlet 52 of the next stage. The diffusers include an outer axially extending ring 56 and an inner axially extending ring 58.

The outer axially extending ring 56 includes an axially extending cylindrical surface 60 in contact with the inner surface of the tubular wall 20. In this manner the diffusers are aligned axially with respect to the housing and consequently with respect to the shaft 14 and impellers 38. Each outer ring 56 is provided with a circumferential groove 62 at the surface 60. At some locations, depending upon the requirements of the particular pump application, an O-ring seal 64 is placed in the groove to provide a fluid-tight seal between the surface 60 and the tubular wall 20.

Each outer axially extending ring 56 further includes a stepped portion 66 at one axial end and an upstanding flange portion 68 at the opposite end. The stepped portion 66 of the diffuser of one stage engages the upstanding flange portion 68 of the next succeeding diffuser. The stepped portion 66 of the bottom diffuser, identified on the drawing as 40*a*, which is the first diffuser adjacent the pump inlet passage 26 is supported upon the support surface 28 of the pump base 18.

The upstanding flange portion 68 of the uppermost diffuser, the one nearest the pump outlet passage 32, is in radially-directed contact with a compression tube 70. This tube is urged in a direction toward the pump base 18 by the top bearing housing 22 threadably secured to the tubular walls 20. The outer axially extending rings 56 of the diffusers 40 are thus placed under a compressive load between the compression tube 70 and the pump base 18 to effect retention of the diffusers in stationary relation with the housing and prevents their rotation within the tubular wall 20 during pumping.

The top housing 22 has webs which extend across the fluid outlet passage 32 and also supports a journal 72 which surrounds a spaced sleeve 74 which in turn surrounds the shaft 14.

A radially directed ring portion 76 is formed on the outer axially extending ring 56 of the diffuser 40 adjacent the upstanding flange portion 68. This ring portion 76 includes a bearing surface 78 which engages a thrust washer 80. The thrust washer 80 is disposed in an annular groove or pocket 82 defined by a depending rim or ring 84 and the depending flange 50 of the lower radial ring 46 of the impeller 38 and receives a portion of the thrust loads encounted during pumping.

A radially directed ring portion 88 of the inner axially extending ring 58 of each diffuser is connected to the outer ring portion 76 by webs 90 and defines with the ring 56 and the radially directed portion 76 thereof a flow passage extending through the diffuser from the outlet 54 of one impeller 38 to the inlet 52 of the next succeeding impeller. The bottom diffuser 40*a* does not include the webs 90 not the inner axially extending ring 58.

The inner axially extending ring 58 of each diffuser includes a radially directed bearing surface 92. A thrust washer 94 is interposed between the surface 92 and a cavity 96 in the next adjacent impeller 38. The cavity is defined by an outer ring 98 and the hub 42 of the impeller. This thrust washer 94 further serves to support the relatively rotating impellers and absorb thrust loads experienced during pumping.

Each of the inner axially extending rings 58 defines an axially extending cylindrical surface or journal 100 adjacent to the shaft 14 and spaced from the shaft a distance substantially equal to the radial thickness of the hub 42 of the impeller 38. Preferably the diameter of the cylindrical surface 100 is slightly larger than the diameter of the hub 42 to allow free relative rotation between these elements. Portions of the hubs 42 of the impellers may be removed and a rubber surfaced bearing element 102 is positioned at these locations; one such bearing element is illustrated.

A thrust washer 104 is supported by a radially extending surface 106 on the impellers 38. In cases where the thrust load is reversed, or in upthrust these washers will contact a lower surface 108 on the next adjacent diffuser 40, so as to absorb the upwardly directed thrust.

Figure 4:
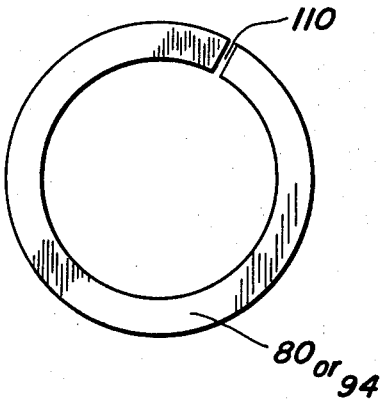
FIG. 4 is a plan view of a thrust washer according to this invention.

The thrust washers 80 and 94 differ primarily in size, so that the bearing 80 or 94 illustrated in FIG. 4 is illustrative of both. Each is a split ring, being split at 110. As previously stated, it has been found that conventional thrust washers, i.e., annular rings, when used in conjunction with pump impellers as described, tend to spin as rotate at speeds less than that of the impellers, which when used for pumping abrasive-containing fluids cause excessive wear that sometimes cuts into or through parts of the impellers. By splitting the thrust washers 80 and 94, as shown, the centrifugal force exerted on the washer when the impeller rotates, and the difference in velocity across the face of the washer in a radial direction, forces the washer to expand. Thus the washer expands into firm engagement with its supporting ring, 84 or 98, as the case may be, and rotates with and at the same speed as the impeller. Spinning of the washers at speeds differing from the impellers is thus eliminated with the elimination of the excessive wear on the impeller parts.

A suitable material for the split thrust washers is a fabric based, laminated plastic, grade CE, which is produced from a cottom fabric weighing over 4 ounces per square yard, and having a thread count not more than 72 per inch in the filler direction and not over 140 total for warp and filler directions. As such it is tough and strong, has high impact strength, machines readily, has great resistance to moisture absorption, and good electrical properties.

The physical properties of NEMA grade CE laminates are as follows:

| | |
|---|---|
| Tensile Strength, psi | |
| Lengthwise | 12,000 |
| Crosswise | 9,000 |
| Compressive Strength, psi | |
| Flatwise | 39,000 |
| Edgewise | 24,500 |
| Flexural Strength, psi | |
| Lengthwise | 17,000 |
| Crosswise | 14,000 |
| Modulus of Elasticity in Flexure, psi | |
| Lengthwise | 900,000 |
| Crosswise | 800,000 |
| Izod Impact, ft. lbs. per inch of notch | |
| Flatwise | 2.30 |
| Edgewise | 1.40 |
| Rockwell Hardness, M Scale | 105 |
| Specific Gravity | 1.33 |
| Coeff. of Thermal Expansion cm/cm/° C | $2 \times 10^{-5}$ |
| Water Absorption, % 24 hrs. | |
| 1/16" | 2.20 |
| 1/8" | 1.60 |
| 1/2" | 0.75 |
| Dielectric Strength, VPM | |
| Perpendicular to laminations | |
| Short Time Test | |
| 1/16" | 500 |
| 1/8" | 360 |
| Dissipation Factor, 1 megacycle | |
| Condition A | 5.5 |
| Maximum Constant Operating Temperature, ° F | 250 |
| Bond Strength - lbs. | 1800 |
| Thickness | |
| Minimum | 0.015" |
| Maximum | 2" |

Of course, within the scope of this invention, other materials having similar characteristics can be used without departing from the spirit of this invention.

A typical thrust washer for an impeller approximately 3 inches in diameter has an outside diameter of approximately 2.375 inches and an inside diameter of approximately 1.875 inches with a thickness of 0.062 inch and a split one/sixteenth inch in width. These dimentions, of course, depend on the size of the impeller.

I claim:

1. In combination with a rotatable element mounted on an axially extending shaft and having an axially open-ended annular cavity defined in part by a substantially circular and axially extending outside rim, and a fixed member arranged adjacent to said rotatable element in junxtaposition to said cavity;

a generally annular thrust washer with a radial split and separation therethrough so as to be substantially C-shaped in plan view positioned in said cavity to be retained by said rim and being rotatable with said rotatable element;

said thrust washer also being in junxtaposition to and contacting said fixed member;

said thrust washer expanding radially upon rotation of said rotatable element due to centrifugal force exerted thereon and thus exerting a retaining force on said rim which retains said washer in said cavity and insures the rotation thereof at substantially the same speed as that of said rotatable elements.

2. In combination with a rotatable pump impeller mounted on an axially extending shaft and rotatable with said shaft, said impeller having an axially open-ended annular cavity defined in part by a substantially circular and axially extending outside rim; and a fixed diffuser member arranged adjacent to said rotatable impeller in junxtaposition to said cavity, a generally annular thrust washer with a radial split and separation therethrough so as to be substantially C-shaped in plan view positioned in said catity to be retained by said rim and being rotatable with said rotatable impeller;

said thrust washer also being in juxtaposition to and contacting said diffuser;

said thrust washer expending radially upon rotation of said rotatable impeller due to centrifugal force exerted thereon and thus exerting a retaining force on said rim which retains said washer in said cavity and insures the rotation thereof at substantially the same speed as that of said rotatable pump impeller.

3. In a multi-stage pump having a plurality of rotatable impellers mounted on an axially extending shaft for rotation therewith, and a plurality of stationary diffusers intermediate the impellers each of which is in juxtapositioned to at least one impeller, at least one axially open-ended annular cavity on each said impellers defined in part by an outside, substantially circular and axially extending rim, each cavity being closely adjacent to an adjacent diffuser;

the improvement comprising;

a generally annular thrust washer with a radial split and separation therethrough so as to be substantially C-shaped in plan view positioned in each said cavity to be retained by said rim and being rotatable with said rotatable impeller and in contact with the adjacent diffuser;

each said thrust washer expanding radially upon rotation of said impellers due to centrifugal force exerted thereon and thus exerting a retaining force on said rim which retains each said washer in its cavity and insures the rotation thereof of substantially the same speed as that of said impellers.

* * * * *